US006070628A

United States Patent [19]

Nastasi

[11] Patent Number: 6,070,628

[45] Date of Patent: Jun. 6, 2000

[54] HANDBAG WITH MAGNETIC CLOSURE FLAP

[76] Inventor: Ancela Nastasi, 666 Greenwich St., Suite 707, New York, N.Y. 10014

[21] Appl. No.: 09/237,740

[22] Filed: Jan. 26, 1999

[51] Int. Cl.[7] ..... A45C 1/02; A45C 3/00; A45C 13/04; A45C 13/10; A45C 13/26

[52] U.S. Cl. ..... 150/118; 150/107; 150/130; 190/902; 383/99

[58] Field of Search ..... 150/107, 118, 150/110; 190/902; 383/99

[56] References Cited

U.S. PATENT DOCUMENTS

| | | | |
|---|---|---|---|
| 1,550,470 | 8/1925 | Tilden | 383/99 X |
| 1,627,496 | 5/1927 | Elias | 150/118 |
| 1,691,906 | 11/1928 | Lefkowitz | 150/118 |
| 1,768,496 | 6/1930 | Trager | 190/902 X |
| 2,037,394 | 4/1936 | Rubin | 150/118 |
| 2,318,563 | 5/1943 | Smith | 150/107 |
| 2,337,860 | 12/1943 | Zeitenberg | 383/99 X |
| 2,431,030 | 11/1947 | Edwards | 383/99 X |
| 2,522,549 | 9/1950 | Waggoner | 150/107 X |
| 2,574,146 | 11/1951 | Gottesman | 190/118 X |
| 3,125,281 | 3/1964 | Woolen | 383/99 X |
| 5,725,039 | 3/1998 | Macinai et al. | 150/118 X |

FOREIGN PATENT DOCUMENTS

| | | | |
|---|---|---|---|
| 758855 | 1/1934 | France | 150/118 |
| 495389 | 1/1956 | Italy | 150/118 |
| 285648 | 1/1953 | Switzerland | 150/118 |
| 682729 | 11/1952 | United Kingdom | 150/110 |
| 696640 | 9/1953 | United Kingdom | 190/109 |

*Primary Examiner*—Sue A. Weaver
*Attorney, Agent, or Firm*—Notaro & Michalos P.C.

[57] ABSTRACT

Handbag with a magnetic flap closure arrangement both closes and latches the top of the handbag. The handbag has arcuate flexible side walls that expand when the front and rear walls of the bag are spread apart to an open position for the bag. The side walls cooperate with the flap arrangement to form a smaller opening that is closed by the flap arrangement when the front and rear walls are moved toward each other into a closed position. The two flaps of the flap arrangement are connected to the front and rear walls respectively, and extend toward each other when the handbag is in the open position. Both are flexible so that they can be pushed downwardly or upwardly to expand the bag opening and allow items to be inserted, removed or seen more easily. In their unflexed, rest positions one flap is lower than the other so that when the front and rear walls are moved toward each other into the closed position, the flaps overlap. A magnet in one of the flaps then attracts a magnetically attractable plate in the other flap to hold the flaps in a selected overlapping position to latch the opening.

7 Claims, 2 Drawing Sheets

HANDBAG WITH MAGNETIC CLOSURE FLAP

FIELD AND BACKGROUND OF THE INVENTION

The present invention relates in general to handbags, and in particular to a new and useful handbag with an overlapping magnetic closure flap arrangement.

Most women need multiple items to support their daily activities. These items include credit cards, photographs, credentials, glasses, a checkbook, a wallet, change purse, keys, stamps, note paper, phone number listings, facial tissues, etc.

To accommodate this need the prior art is replete with handbags of various sizes, shapes and designs. In view of the value of many of the items in the bag, there has also been much attention paid to the closing and latching mechanisms for handbags. Despite the need to securely close the bag, the handbag must also be easy and quick to open, and, when open, it must be easy to access the interior for viewing and to retrieve the needed items.

SUMMARY OF THE INVENTION

An object of the present invention is to provide a handbag which is extremely easy to open and close, and one which, when open, allows easy viewing and access to the interior. The handbag of the present invention also closes and latches quickly and easily, yet securely.

Accordingly another object of the invention is to provide a handbag with a magnetic flap closure arrangement which both closes and latches the top of the handbag. The handbag has arcuate flexible side walls that expand when the front and rear walls of the bag are spread apart to an open position for the bag. The side walls cooperate with the flap arrangement to form a smaller opening in the closed position of the front and rear walls, that is closed by the flap arrangement when the front and rear walls are moved toward each other into the closed position. The one or two flaps of the flap arrangement are connected to the front and rear walls respectively, and extend toward the other wall or toward each other when the handbag is in the open position. Each flap is flexible so that each can be pushed downwardly or upwardly to expand the bag opening and allow items to be inserted, removed or seen more easily. In their un-flexed, rest positions one flap is lower than the other so that when the front and rear walls are moved toward each other into the closed position, the flaps overlap. A magnet in one of the flaps then attracts a magnetically attractable plate or a magnet in the other flap to hold the flaps in a selected overlapping position to latch the opening.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
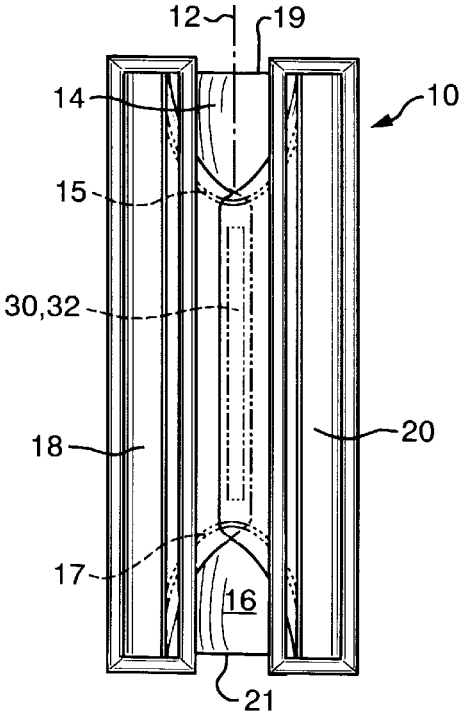
FIG. 1 is a top plan view of a handbag of the present invention in its closed position.

Referring to the drawings in particular, the invention embodied therein comprises a handbag generally designated 10, having magnetic flap closure arrangement 12 for both closing and latching the top of the handbag.

Figure 2:
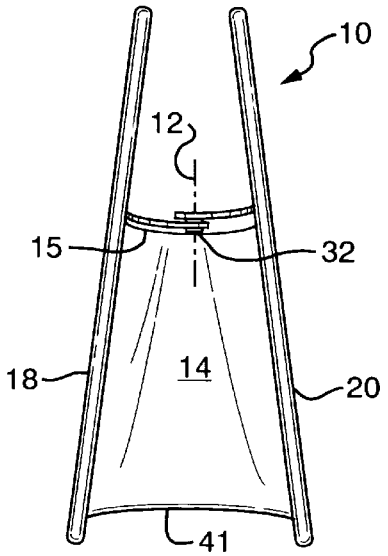
FIG. 2 is a side sectional view of the bag in its closed position.
Figure 3:
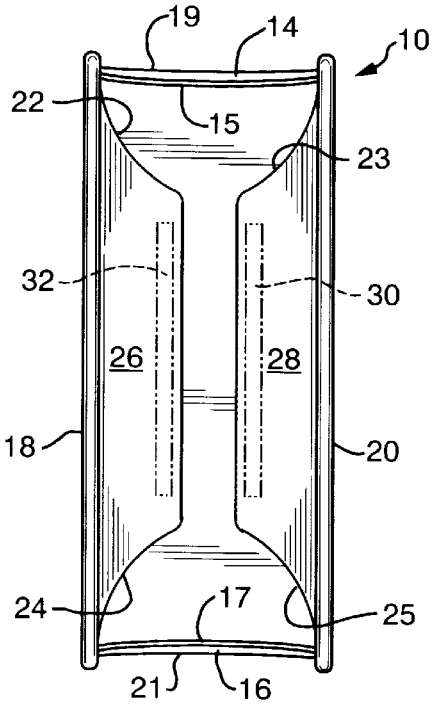
FIG. 3 is a top plan view of the handbag in its open position.
Figure 4:
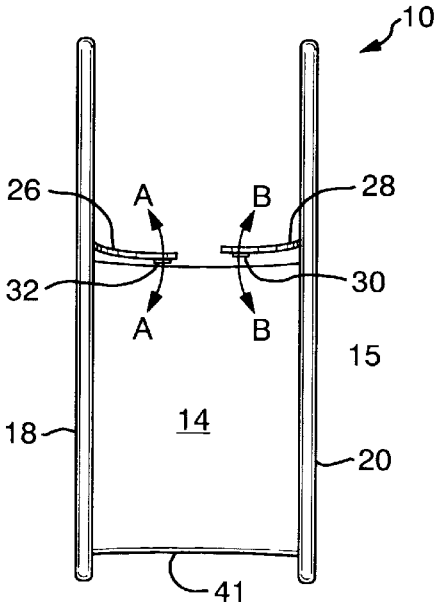
FIG. 4 is a side sectional view of the bag in its open position.

The handbag has a pair of opposite, arcuate, flexible side walls 14 and 16, that expand when the front and rear walls of the bag are spread apart to an open position for the bag shown in FIGS. 3 and 4. The side walls 14,16 cooperate with the flap arrangement 12 to form a smaller opening when front and rear walls 18 and 20 are moved toward each other in a closed position shown in FIGS. 1 and 2. In this position the arcuate upper edges 15 and 17 of the side walls 14 and 16, extend adjacent the curved, partly overlapping side edges 22, 23, 24 and 25 of a pair of flaps 26 and 28, that form the flap arrangement 12. That is, the upper opening of the bag is automatically and closely closed by the flap arrangement and side walls when the front and rear walls are moved toward each other into the closed position.

Although one flap extending from only one of the front or rear walls can form the flap arrangement, in the preferred embodiment of the invention, two flaps 26 and 28 of the flap arrangement are connected to the front and rear walls respectively, and extend toward each other when the handbag is in the open position as shown in FIGS. 3 and 4. Both are flexible so that they can be pushed downwardly or upwardly in the directions of arrows A and B in FIG. 4, to further expand the bag opening in its open position, and allow items to be inserted, removed or seen more easily. In their un-flexed, rest positions shown in FIG. 4, one flap (26) is lower than the other flap (28) so that when the front and rear walls 18,20 are moved toward each other into the closed position, the flaps automatically overlap as shown in FIGS. 2 and 5.

Magnet means in the form of a magnet 30 in one of the flaps then attracts a magnetically attractable plate or magnet 32 (with correct pole orientation), in the other flap, to hold the flaps in a selected overlapping position to latch the opening closed. Placement of the magnet means in or on the flaps will define the closed and latched position because the magnet(s) and/or attractable plated tend to center each other as shown in FIG. 1. Thus when a closed position with the front and rear walls 18,20 closer to each other is desired, the magnet means are places further away from the free edges of the flaps 26,28, or the flaps are made narrower, or both.

The size and shape of the side walls 14,16 and the size and shape of the flaps, and in particular their side edges 22–25, are also carefully selected to insure that the top of the bag is fully closed in the closed position as shown in FIG. 1. The flaps may of equal width and length or of different width and/or length.

Figure 5:
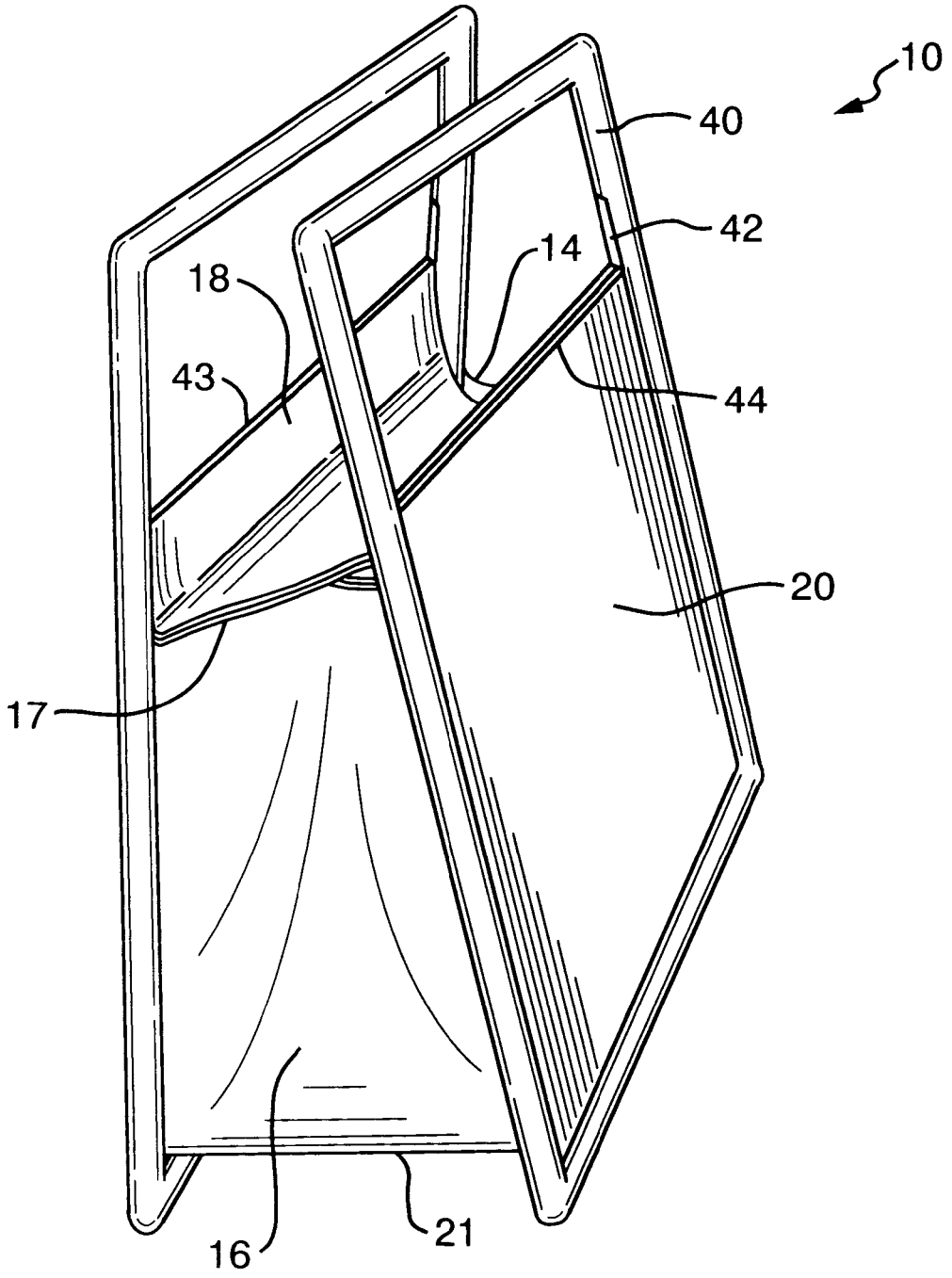
FIG. 5 is a perspective view of the handbag in its closed position.

FIG. 5 illustrates another feature of the invention. The side walls 14,16 have lower edges 21 and 19 (FIG. 1) that are sewn or otherwise attached to a bottom panel 41 of the handbag 10. Front and rear walls 18 and 20 have lower ends attached to the bottom panel. The front and rear walls are each bounded by a tubular (preferably cylindrical) metal frame 40 having an interior slot 42 for receiving the leather or other material making up the front and rear walls 18,20. Flexible flaps 26,28 are sewn or otherwise attached to inner facing surfaces of the walls 18,20, preferably below upper edges 43,44 of the walls. Upper portions of the frames 40 have sides and a top member which extend above the upper edges of the walls, to form handles which extend upwardly from one or both of the front and rear walls.

As also evident in FIG. 5, the side walls are shaped to be arcuate and concave inwardly toward the interior of the handbag 10. This allows the side walls to naturally expand to enlarge the interior of the handbag (FIG. 3) in its open position. The side walls contract and moved toward each other to form the smaller upper opening and meet the side edges of the flaps as the front rear walls are moved to the closed position (FIG. 1).

While a specific embodiment of the invention has been shown and described in detail to illustrate the application of the principles of the invention, it will be understood that the invention may be embodied otherwise without departing from such principles.

What is claimed is:

1. A handbag comprising:

a front wall;

a rear wall;

a bottom wall connected between the front and rear walls to partially define a bag interior, upper ends of the front and rear walls bounding an upper opening into the interior;

a pair of arcuate flexible side walls connected to and between opposite sides of the front and rear walls for further defining the bag interior, the side walls being shaped so that when the upper ends of the front and rear walls are spread apart to an open position for the handbag, the side walls change shape to enlarge the bag interior and to enlarge the upper opening, and when the upper ends of the front and rear walls are moved toward each other to a closed position for the handbag, the side walls change shape to reduce the bag interior and to reduce the upper opening;

a flap arrangement extending over the opening of the bag to close the opening when the front and rear walls are moved toward each other into the closed position and to cover at least part of the opening in the open position of the handbag, the flap arrangement being flexible so that it can be pushed aside to expand the opening and allow items in or for the interior to be inserted, removed and seen more easily; and latch means connected to the flap arrangement for latching the opening closed in the closed position of the handbag;

the flap arrangement comprising a pair of flaps extending respectively from the front and rear walls, toward the bag opening, each flap having an un-flexed, rest position with one flap lower than the other flap so that when the front and rear walls are moved toward each other into the closed position, the flaps at least partly overlap, the latch means comprising a magnet connected to one of the flaps and a magnetically attractable member connected to the other flap to hold the flaps in a selected overlapping position to latch the opening closed.

2. A handbag according to claim 1, wherein the side walls are arcuate and each have arcuate upper edges which extend adjacent curved, partly overlapping side edges of the flaps in the closed position for closely closing the bag opening.

3. A handbag according to claim 2, wherein the side walls are shaped to be concave inwardly toward the interior of the handbag so that the side walls expand to enlarge the interior of the handbag in the open position, and contract when the front and rear wall move toward each other to form the smaller upper opening in the closed position.

4. A handbag comprising:

a front wall;

a rear wall;

a bottom wall connected between the front and rear walls to partially define a bag interior, upper edged of the front and rear walls bounding an upper opening into the interior;

a pair of arcuate flexible side walls connected to and between opposite sides of the front and rear walls for further defining the bag interior, the side walls being shaped so that when the upper edges of the front and rear walls are spread apart to an open position for the handbag, the side walls change shape to enlarge the bag interior and to enlarge the upper opening, and when the upper edges of the front and rear walls are moved toward each other to a closed position for the handbag, the side walls change shape to reduce the bag interior and to reduce the upper opening;

a flap arrangement extending over the opening of the bag to close the opening when the front and rear walls are moved toward each other into the closed position and to cover at least Part of the opening in the open position of the handbag, the flap arrangement being flexible so that it can be pushed aside to expand the opening and allow items in or for the interior to be inserted, removed and seen more easily; and latch means connected to the flap arrangement for latching the opening closed in the closed position of the handbag, the flap arrangement comprising a pair of flaps extending respectively from the front and rear walls, toward the bag opening, each flap having an un-flexed, rest position with one flap lower than the other flap so that when the front and rear walls are moved toward each other into the closed position, the flaps at least partly overlap, the latch means comprising a magnet connected to one of the flaps and a magnetically attractable member connected to the other flap to hold the flaps in a selected overlapping position to latch the opening closed; and a pair of tubular frames each having an interior slot for receiving and retaining the front and rear walls respectively.

5. A handbag according to claim 4, wherein an upper portion of at least one of the frames extends above the upper edges of the front and rear walls to form a handle.

6. A handbag according to claim 4, wherein the side walls are arcuate and each have arcuate upper edges which extend adjacent curved, partly overlapping side edges of the flaps in the closed position for closely closing the bag opening.

7. A handbag according to claim 6, wherein the side walls are shaped to be concave inwardly toward the interior of the handbag so that the side walls expand to enlarge the interior of the handbag in the open position, and contract when the front and rear wall move toward each other to form the smaller upper opening in the closed position.

* * * * *